US006978507B2

(12) United States Patent
Spaulding

(10) Patent No.: US 6,978,507 B2
(45) Date of Patent: Dec. 27, 2005

(54) BOTTLE WASH AND DRY DEVICE

(76) Inventor: Jennifer L. Spaulding, 417 Hatchee Dr., Crestview, FL (US) 32536

( * ) Notice: Subject to any disclaimer, the term of this patent is extended or adjusted under 35 U.S.C. 154(b) by 283 days.

(21) Appl. No.: 10/355,123

(22) Filed: Jan. 31, 2003

(65) Prior Publication Data

US 2004/0148721 A1 Aug. 5, 2004

(51) Int. Cl.[7] ..... A47L 13/12
(52) U.S. Cl. ..... 15/118; 15/211; 15/244.1
(58) Field of Search ..... 15/118, 211, 244.1, 15/145, 210.1, 226, 220.1, 229.1, 229.2, 15/223, 224, 225; D4/119, 137

(56) References Cited

U.S. PATENT DOCUMENTS

| | | | | |
|---|---|---|---|---|
| 127,754 | A * | 6/1872 | Ford | 15/118 |
| 1,254,217 | A | 1/1918 | Drummond | |
| 1,276,874 | A | 8/1918 | Clarke | |
| 1,507,971 | A | 9/1924 | Lomp | |
| 1,680,713 | A | 8/1928 | Wittenberg | |
| 1,866,862 | A * | 7/1932 | Prestwich et al. | 15/210.1 |
| 1,890,894 | A * | 12/1932 | Sanford et al. | 15/244.1 |
| 2,370,414 | A * | 2/1945 | Ostrander | 15/105 |
| D171,592 | S * | 3/1954 | Gors | D4/119 |
| 2,789,305 | A * | 4/1957 | Weil | 15/244.1 |
| 2,983,944 | A | 5/1961 | Uselis | |
| 3,231,921 | A * | 2/1966 | Cuervo | 15/244.1 |
| 3,750,214 | A | 8/1973 | Caliendo et al. | |
| 3,862,461 | A | 1/1975 | Bucklitzsch | |
| 5,253,386 | A | 10/1993 | LaLonde | |
| 5,339,480 | A | 8/1994 | Murg et al. | |
| D356,683 | S * | 3/1995 | Jefferson | D4/116 |
| 6,202,247 | B1 * | 3/2001 | Lorenz, Jr. | 15/118 |
| 2003/0024541 | A1 * | 2/2003 | Shum | 132/75.3 |

* cited by examiner

*Primary Examiner*—Gary K. Grhama
(74) *Attorney, Agent, or Firm*—Richard C. Litman

(57) ABSTRACT

A bottle washing and drying implement has a handle with two ends, the ends being provided with removable washing and drying attachments, respectively. In particular, the drying attachment has a plurality of looped strips of drying material, such as natural or artificial chamois, fastened to a holder. The holder is fastened to the handle by a threaded stud and a corresponding threaded opening; the stud can protrude from the end of the handle to fit securely into a corresponding aperture in the attachment, or the stud can protrude from the attachment to fit into a corresponding aperture in the end of the handle.

8 Claims, 4 Drawing Sheets

BOTTLE WASH AND DRY DEVICE

BACKGROUND OF THE INVENTION

1. Field of the Invention

The present invention relates to bottle wash and dry devices. More particularly, the invention is a hand-held implement having two ends, one for washing and the other for drying, the washing and drying ends being replaceable and being attached to the respective ends of a handle using threaded fittings.

2. Description of the Related Art

Hand-held bottle washing devices, e.g., brushes, used for washing bottles and similar kitchen objects are generally known. However, when the washing (or drying) parts of the devices wear out in these devices, the entire device is generally discarded and replaced. There is a need for a hand-held device for both washing and drying in which the ends, especially the drying portion, are replaceable, thereby avoiding the need to discard the entire device. Instead, only the removable portion is discarded and replaced.

U.S. Pat. No. 1,254,217, issued to Drummond on Jan. 22, 1918, teaches a bottle brush having a movable cleaning attachment designed to clean bottle lips. U.S. Pat. No. 1,276,874, issued to Clarke on Aug. 27, 1918, teaches a spinning bottle brush that cleans the inside of a bottle when spun U.S. Pat. No. 1,507,971, issued to Lomp on Sep. 9, 1924, teaches a spinning bottle brush including a stopper. U.S. Pat. No. 1,680,713, issued to Wittenberg on Aug. 14, 1928, teaches another spinning bottle brush. U.S. Pat. No. 2,983,944, issued to Uselis on May 16, 1961, teaches a spring-loaded hand-held cleaning brush. U.S. Pat. No. 3,750,214, issued to Caliendo et al. on Aug. 7, 1973, teaches a spinning bottle cleaner. U.S. Pat. No. 3,862,461, issued to Bucklitzsch on Jan. 28, 1975, teaches a bottle cleaning brush that is cranked.

U.S. Pat. No. 5,253,386, issued to LaLonde on Oct. 19, 1993, teaches a tube cleaning brush. U.S. Pat. No. 5,339,480, issued to Murg et al. on Aug. 23, 1994, teaches a hand-held bottle and nozzle cleaning brush having different opposite ends. U.S. Pat. No. 5,351,356, issued to Townsend, Jr. on Oct. 4, 1994, teaches a sponge on a handle.

Although hand-held cleaning implements are generally known, there is a need for an implement conveniently usable both for washing and for drying in which the washing and drying parts of the brush are detachable and replaceable for when they wear out, without needing to discard and replace the entire device. The present invention fills this need by providing a hand-held cleaning implement in which detachable and replaceable end attachments are attached to a handle with threaded fittings.

None of the above inventions and patents, taken either singly or in combination, is seen to describe the instant invention as claimed. Thus a bottle wash/dry unit solving the aforementioned problems is desired.

SUMMARY OF THE INVENTION

The present invention is a bottle wash and dry device having a handle with two different removable, replaceable ends: one for washing, and the other for drying. The ends can be screwed to the handle using threaded fittings. The washing end can be any suitable washing material, such as a sponge. The drying end can be any suitable material and, preferably, includes a plurality of loops of a drying material, such as natural or artificial chamois cloth or microfiber cloth mounted on a holder, preferably a conical-shaped holder.

Accordingly, it is a principal object of the invention to provide a cleaning brush having removable, replaceable ends.

It is another object of the invention to provide the above brush including a washing end and a drying end, in which the drying end includes a plurality of looped strips of drying material, such as natural or artificial chamois.

It is a further object of the invention to provide the above device in which the looped strips of drying material are fastened to a holder, the holder and the fastened loops being replaceable as an integral attachment.

Still another object of the invention is to provide the above device in which the replaceable attachments are attached to the handle using threaded fittings.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to hand-held devices that combine the capabilities of washing and drying. More particularly, the present invention is a bottle wash and dry device having a handle that includes two different removable ends, corresponding to the washing and drying parts of the apparatus, respectively, that can be replaced when worn out, without needing to replace the entire device.

Figure 1:
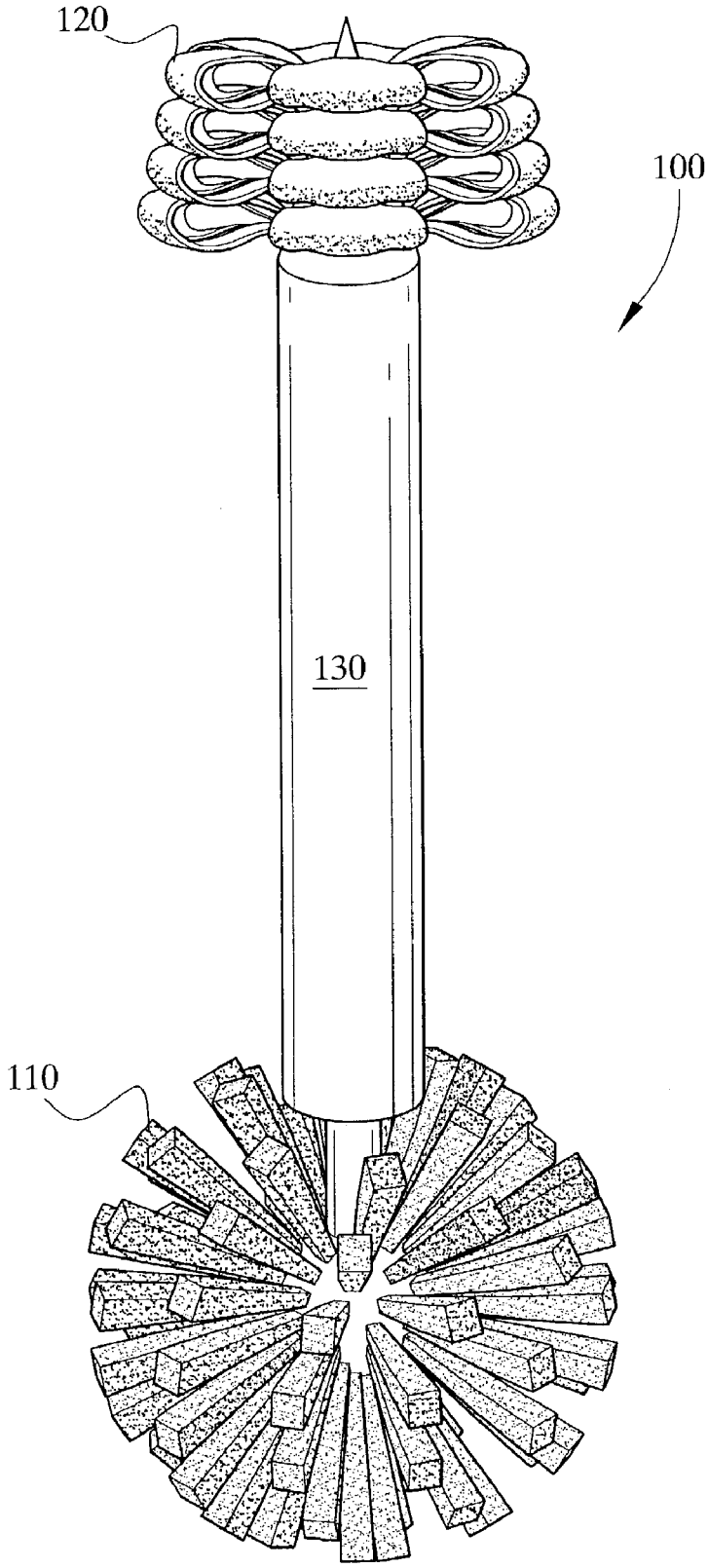
FIG. 1 is a perspective view of a first embodiment of a bottle wash and dry device according to the present invention.

FIG. 1 shows a first embodiment of a washing and drying device 100 according to the invention. The device 100 has a handle 130. An attachment for washing, in this case, a star-burst shaped sponge 110, is attached to one end of the handle 130. However, any suitable washing attachment is also contemplated, including porous cloths, such as terry cloth and washing rags, as well as sponges of various sizes and shapes. The drying attachment 120 is at the opposite end of the handle 130. Details of the drying attachment will be discussed as follows.

Figure 2:
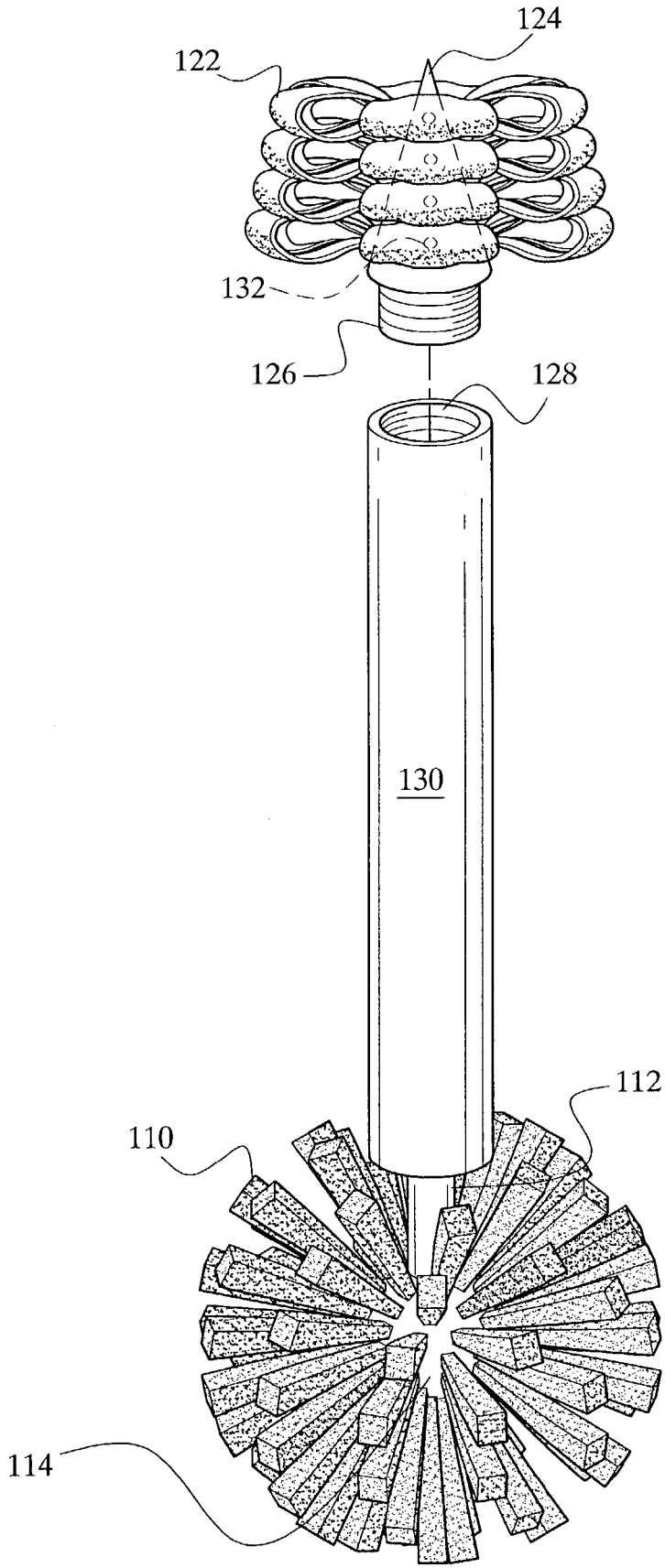
FIG. 2 is a partially exploded view of the device of FIG. 1.

FIG. 2 is a partially exploded view of FIG. 1, showing the manner of fastening the drying attachment to the handle in the first embodiment, including details of the structure. The drying attachment includes a conical holder 124 having an externally threaded fitting 126 to match the internally threaded fitting 128 at the end of the handle 130. Strips 122 of looped drying material, e.g., chamois cloth, are connected at their ends into openings 132 in the holder 124. The free ends of the looped strips 122 can be mechanically fastened to the holder 124, e.g., by force-fit, similar in fashion to the process of tufting as used in the manufacture of pile carpets, bristle brushes and doll heads that include hair. Alternatively, the ends of the loops 122 can be fastened to the holder 124 with a suitable adhesive.

The sponge in this case, having a star-burst shape, is made up of a plurality of elongated rod-shaped elements projecting radially from a central spherical core 114. Core 114 is fastened to a connector 112, that is attached to the handle 130 in a manner known in the art including, for example, threaded fittings, as in the case of the drying attachment 120.

Figure 3:
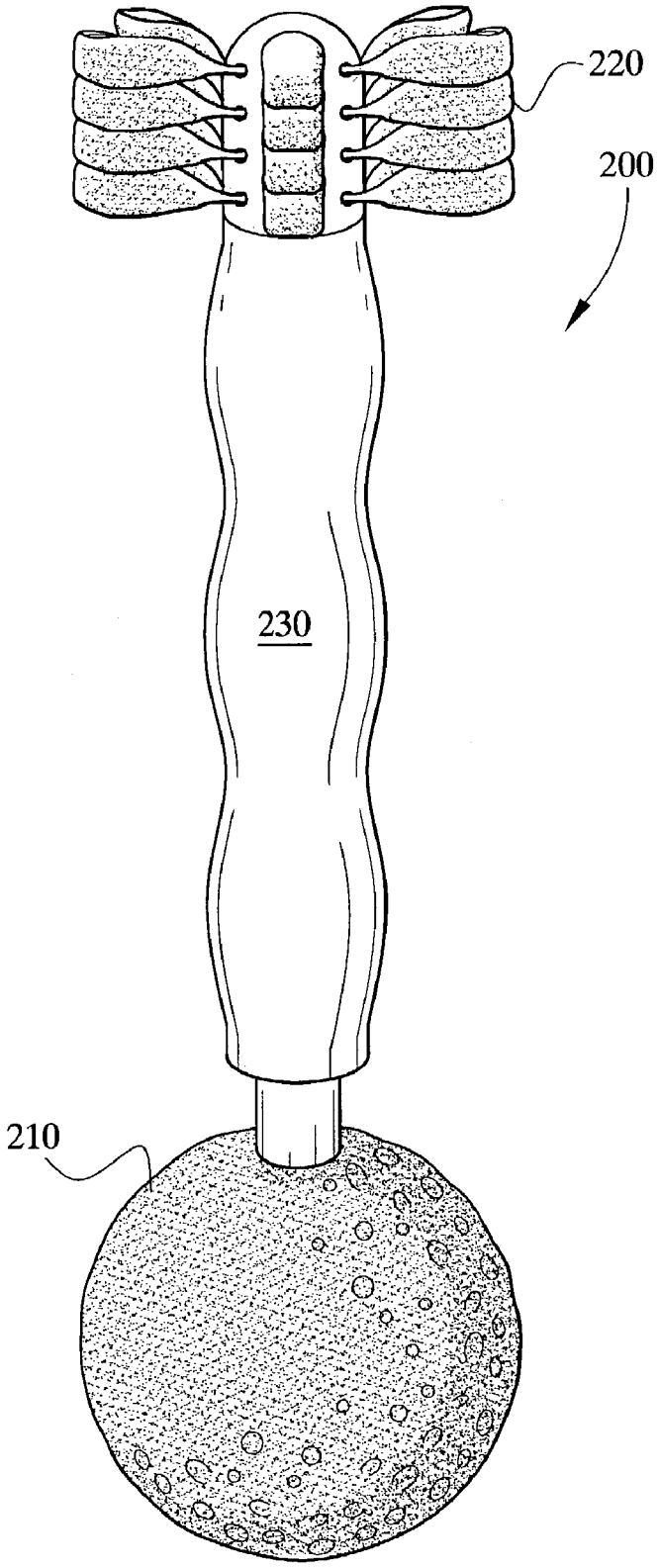
FIG. 3 is a perspective view of a second embodiment of a bottle wash and dry device according to the present invention.

FIG. 3 shows a second embodiment 200 of a washing and drying device according to the present invention. In this case, the handle 230 is contoured for better grip. At one end, the device 200 has a ball-shaped sponge attachment 210 connected to the handle 230. However, any washing attachment suitable for washing bottles, flower vases, glasses, etc., is also contemplated. At the opposite end of the handle 230 is the drying attachment 220.

Figure 4:
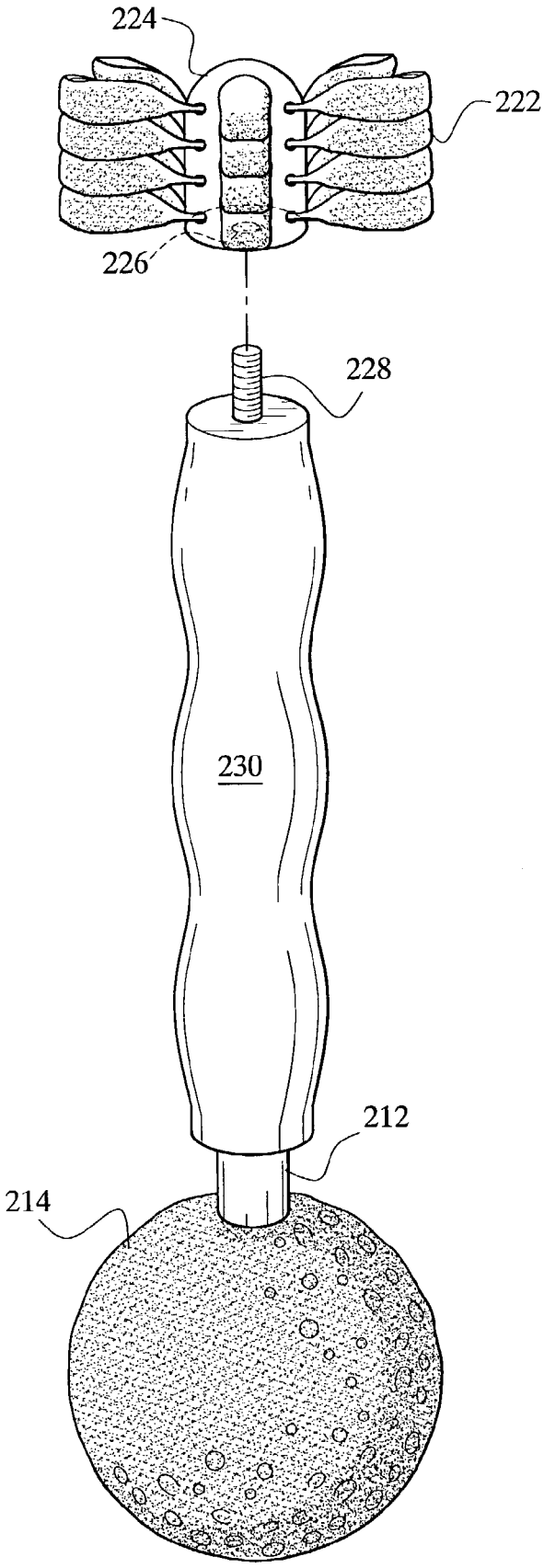
FIG. 4 is a partially exploded view of the device of FIG. 3.

FIG. 4 shows a partially exploded view of the device of FIG. 3, showing an alternate manner of fastening the drying attachment to the handle. In this case, the drying attachment 220 is provided with an internally threaded opening 226 and the handle 230 has an externally threaded stud 228.

The handle can be made of any suitable material, including wood and plastic. The holder for the drying attachment can be wood, plastic or metal mesh, as long as the holder has a plurality of attachment locations for fastening the ends of the drying strips. The ends of the drying strips can be mechanically fastened, such as by tufting the ends into the core using known tufting apparatus, or by adhesive. Types of drying material that can be used include natural chamois leather and artificial chamois, such as microfiber cloth, as long as the material is capable of absorbing water and being reusable.

Exemplary dimensions for the handle are 4½ to 5½ inches long for a shorter version, or 7½ to 8½ inches long for a longer version, and may be contoured for better grip. The length of the handle depends upon the particular application, e.g., for longer kitchen objects, such as tall drinking glasses, a device having a longer handle would be preferred.

The looped drying strips can be ½ to 1 inch in width and about 2–4 inches long before folding into loops. Approximately 15–40 strips are fastened to the core of the drying attachment.

The washing attachment can be attached to the handle in any suitable manner, including a threaded stud and threaded aperture as used for the drying attachment. The washing attachment can also be permanently fastened to the handle. Types of washing materials usable in the washing attachment include brushes, sponges, etc.

It is to be understood that the present invention is not limited to the embodiments described above, but encompasses any and all embodiments within the scope of the following claims.

I claim:

1. A bottle cleaning implement for use in washing and drying, comprising:

an elongated handle having a first end and a second end;

a washing attachment attached to the first end of the handle; and a drying attachment removably attached to the second end of the handle;

wherein said drying attachment includes a holder and a plurality of strips of drying material, each strip including two ends, each said strip fastened to said holder at said two ends;

whereby said strips form loops extending outwardly from said holder.

2. The bottle cleaning implement of claim 1, wherein at least one of the ends of the handle includes an internally threaded aperture and at least one of the attachments includes an externally threaded fitting capable of engaging the internally threaded aperture to fasten the at least one attachment to the handle.

3. The bottle cleaning implement of claim 1, wherein the strips are fastened randomly on the holder.

4. The bottle cleaning implement of claim 1, wherein the strips are placed in a regular pattern on the holder.

5. The bottle cleaning implement of claim 1, wherein the holder has a substantially conical shape, the apex of the core extending outwardly from the handle.

6. The bottle cleaning implement of claim 1, wherein the holder has a substantially cylindrical shape, the axis of the holder extending co-axially with the elongated handle.

7. The bottle cleaning implement of claim 1, wherein the drying strips are made of a material selected from the group consisting of natural chamois leather, synthetic chamois and microfiber cloth.

8. The bottle cleaning implement according to claim 1, wherein said washing attachment comprises a sponge removably attached to said handle.

* * * * *